United States Patent [19]

Hosoi et al.

[11] Patent Number: 4,637,706

[45] Date of Patent: Jan. 20, 1987

[54] DEVELOPER THIN LAYER FORMING APPARATUS

[75] Inventors: Atsushi Hosoi, Tokyo; Fumitaka Kan, Yokohama; Hidemi Egami, Zama; Hatsuo Tajima, Matsudo; Shunji Nakamura; Kimio Nakahata, both of Kawasaki, all of Japan

[73] Assignee: Canon Kabushiki Kaisha, Tokyo, Japan

[21] Appl. No.: 618,558

[22] Filed: Jun. 8, 1984

[30] Foreign Application Priority Data

Jun. 14, 1983 [JP] Japan ..... 58-104986
Jun. 14, 1983 [JP] Japan ..... 58-104987

[51] Int. Cl.[4] ..... G03G 15/00
[52] U.S. Cl. ..... 355/3 DD; 355/14 D
[58] Field of Search ..... 355/3 DD, 14 D; 430/120, 122; 222/DIG. 1; 118/621–623, 656–658

[56] References Cited

U.S. PATENT DOCUMENTS 4,244,322 1/1981 Nomura et al. ..... 118/658
4,386,577 6/1983 Hosono et al. ..... 222/DIG. 1
4,387,664 6/1983 Hosono et al. ..... 355/3 DD X
4,391,512 7/1983 Nakamura et al. ..... 118/658 X
4,406,535 9/1983 Sakamoto et al. ..... 355/3
4,548,489 10/1985 Yoshikawa ..... 355/3 DD

*Primary Examiner*—Arthur T. Grimley
*Assistant Examiner*—C. Romano
*Attorney, Agent, or Firm*—Fitzpatrick, Cella, Harper & Scinto

[57] ABSTRACT

A developing apparatus, including, a developer supply container, having an opening, for containing a non-magnetic developer and magnetic particles, an endlessly movable developer carrying member of a non-magnetic material for carrying a developer, which is movable between an inside of the developer supply container and an outside of the developer supply container through the opening, a magnetic particle confining member, spaced from outer surface of the developer carrying member with a gap, a magnet for generating a fixed magnetic field, having a magnetic pole disposed inside of the carrying member and upstream of the confining member with respect to movement of the developer carrying member, and a magnet, disposed outside of the carrying member in proximity with the confining member at an upstream side thereof with respect to movement of the developer carrying member.

29 Claims, 8 Drawing Figures

DEVELOPER THIN LAYER FORMING APPARATUS

BACKGROUND OF THE INVENTION

The present invention relates to an apparatus for forming a thin layer of dry developer, and a developing apparatus using the same, more particularly to those using a non-magnetic developer.

Conventionally, various types of apparatus have been proposed and put into practice as to a dry type one-component developer apparatus. However, in any of those types, it has been very difficult to form a thin layer of one-component dry developer, so that a relatively thick layer of the developer is used. On the other hand, the recent device for the improved sharpness, resolution or the other qualities has necessiated the achievement of the system for forming a thin layer of one-component dry developer.

A method of forming a thin layer of one-component dry developer has been proposed in U.S. Pat. Nos. 4,386,577 and 4,387,664 and this has been put into practice. However, this is the formation of a thin layer of a magnetic developer, not of a non-magnetic developer. The particles of a magnetic developer must each contain a magnetic material to gain a magnetic nature. This is disadvantageous since it results in poor image fixing when the developed image is fixed on a transfer material, also in poor reproducibility of color (because of the magnetic material, which is usually black, contained in the developer particle).

Therefore, there has been proposed a method wherein the developer is applied by cylindrical soft brush made of, for example, beaver fur, or a method wherein the developer is applied by a doctor blade to a developer roller having a textile surface, such as a velvet, as to a formation of non-magnetic developer thin layer. In the case where the textile brush is used with a resilient material blade, it would be possible to regulate the amount of the developer applied, but the applied toner layer is not uniform in thickness. Moreover, the blade only rubs the brush so that the developer particles are not charged, resulting in foggy images.

A method and a device wherein a thin layer of non-magnetic developer is formed with the use of magnetic particles confined by a magnetic field, are proposed in U.S. Ser. Nos. 466,574 and 527,397, both of which have been assigned to the assignee of the subject application.

However, in the case where the distribution of the magnetic particle diameters is so broad that there are magnetic particles having a diameter smaller than that of the non-magnetic developer particles, it is possible that those small diameter magnetic particles are undesirably contained in the formed thin layer. Also, if the flowability of the developer is increased in order to extend the life of the developer, the magnetic particles are possibly not sufficiently confined and tend to leak out. If the magnetic particles are contained in the thin layer coating, they can transfer to the latent image bearing member to deteriorate the quality of the developed image, or they can damage the latent image bearing member.

SUMMARY OF THE INVENTION

It is a principal object of the present invention to provide an improved apparatus for forming a thin layer of a developer.

It is another object of the present invention to provide an improved apparatus for forming a thin layer of non-magnetic developer, using magnetic particles.

It is another of the present invention to provide a apparatus wherein the magnetic particles are used for forming a thin layer non-magnetic developer, and wherein the possibility of the magnetic particles being contained in the thin layer of the magnetic developer is effectively eliminated.

According to an embodiment of the present invention there is provided a developing apparatus, including, a developer supply container, having an opening, for containing a non-magnetic developer and magnetic particles, an endlessly movable developer carrying member of a non-magnetic material for carrying a developer, which is movable between an inside of the developer supply container and an outside of the developer supply container through the opening, a magnetic particle confining member, spaced from an outer surface of the developer carrying member with a gap, means for generating a fixed magnetic field, having magnetic pole means disposed inside of the carrying member and upstream of the confining member with respect to movement of the developer carrying member, and a magnet, disposed outside of the carrying member in proximity with the confining member at an upstream side thereof with respect to movement of the developer carrying member. The possibility of leakage of the magnetic particles through the clearance between the confining member and the carrying member is substantially prevented by the confining member. However, the magnet further reduce the possibility of the leakage. Thus, the magnetic particles is further prevented from reaching the developing station.

According to another embodiment of the present invention, there is provided a developing apparatus comprising, a developer supply container, having an opening, for containing a non-magnetic developer and magetic particles, an endlessly movable developer carrying member of a non-magnetic material for carrying a developer which is movable between an inside of the developer supply container and an outside of the developer supply container through the opening, a magnetic particle confining member, provided to an outer surface of the developer carrying member with a gap, means for generating a fixed magnetic field, having magnetic pole means disposed inside of the carrying member and upstream of the confining member with respect to movement of the developer carrying member, and a magnetic pole of the same polarity as that of the magnetic pole of the fixed magnetic field generating means and disposed in close proximity with and upstream of the magnetic particle confining member with respect to movement of said developer carrying member to steeply decrease, at a downstream of said carrying member, a magnetic flux density, on a surface of the carrying member, of the magnetic field formed by the magnetic pole of said fixed magnetic field generating means. The steep decrease is effective to further reduce the possibility of the leakage through the clearance between the confining member and the carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiment of the present invention will be described in detail in conjunction with the accompanying drawings.

Figure 1:
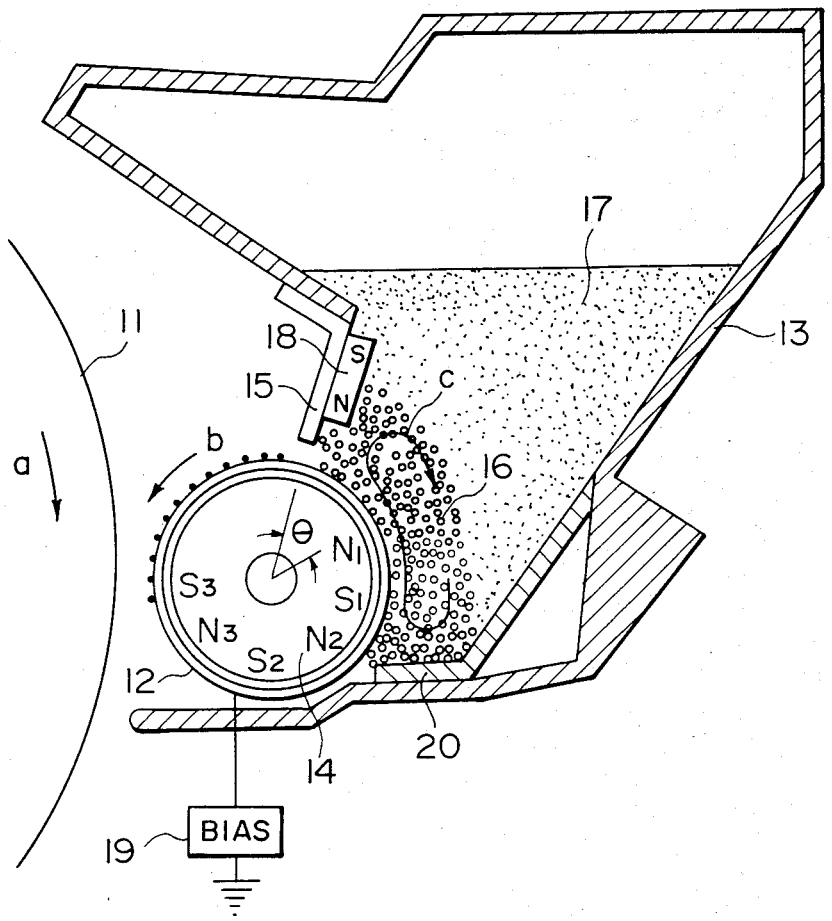
FIG. 1 is a cross-sectional view of an apparatus according to an embodiment of the present invention.

FIG. 1 illustrates a developer thin layer forming device or a developing apparatus usable with the above-described copying apparatus, wherein a photosensitive member 11 rotates in the direction of arrow a. Opposed to the surface of the photosensitive member 11 with a gap, a non-magnetic member 12 for carrying a developer is provided. In this embodiment, the developer carrying member 12 is in the form of a cylinder, or more particularly, a sleeve, but it may be an endlessly movable web, as with photosensitive member 11. With the rotation of the photosensitive member 11, the carrying member 12 is rotated in the direction of arrow b. A developer supply container 13 is provided to supply the developer to the carrying member 12. The container 13 is provided with an opening adjacent its lower part. The carrying member 12 is provided in the opening. Since the carrying member 12 is partly exposed outside, the surface thereof moves from the inside of the container 13 to the outside thereof and then back into the container 13. The container 13 has a bottom portion which encloses the carrying member 12 to prevent the developer from leaking out.

Inside the carrying member 12, magnetic field generating means, i.e., a magnet 14 in this embodiment, is fixedly supported so that the carrying member 12 only rotates. The magnet 14 has magnetic poles N1, S1, N2, S2, N3 and S3.

The magnetic pole N1 is effective to confine the magnetic particles within the container 13, which will be described in detail hereinafter. The pole S1 is effective to circulate the magnetic brush formed with magnetic particles in accordance with rotation of the carrying member 12. The pole N2 is effective to form a magnetic brush to prevent the magnetic particles from leaking out.

In the neighbourhood of the upper part of the container 13 opening, a confining or regulating member 15, as magnetic particle confining means, is provided to confine within the container 13 magnetic particles which will be described hereinafter. The confining member 15 is of a magnetic material, i.e., a magnetic blade in this embodiment. Across the carrying member 12 from the confining member 15, there is a magnetic pole N1 of the magnet 14. However, the magnetic pole N1 is not right across, and displaced by a predetermined angle $\theta$ (5–50 degrees) toward upstream with respect to the direction of the movement of the carrying member 12.

A piece of magnetic material, for example, iron is provided on the inside of the container 13 wall opposed to the magnetic pole N2, to form a magnetic brush so as to seal the bottom of the container 13 and to improve the circulation.

Into the container 13 of the above-descrived structure, magnetic particles or a mixture of magnetic particles and non-magnetic developer particles are supplied so that a base layer 16 is formed. The mixture constituting the base layer 16 preferably contains 5–70 wt. % of non-magnetic developer, but may only have magnetic particles. The particle diameter of the magnetic particle is 30–200, preferably 70–150 microns. Each of the magnetic particles may consist of a magnetic material or may consist of a magnetic material and non-magnetic material. The magnetic particle in the base layer 16 is formed into a magnetic brush by the magnetic field provided by the magnet 14, which brush is effective to perform a circulation which will be described in detail hereinafter. A magnetic brush is also formed between the magnetic pole N1 and the magnetic particle confining member 15, which is effective to constrain the magnetic particles of the base layer 16 within the container 13.

Above the base layer 16, non-magnetic developer particles are supplied to form a developer layer 17, so that two layers are formed generally horizontally in the container 13, that is, the base layer 16 on the outside of the carrying member 12 and the developer layer 17 on the further outside thereof. The non-magnetic developer supplied may contain a small amount of magnetic particles, but even in that case, the magnetic particle content of the developer layer 17 is smaller than that of the base layer 16. To the non-magnetic developer particle, silica particle for enhancing the flowability and/or abrasive particles for effectively abrading the surface of the photosensitive member 11 may be added. The formation of the two layers is not limited to this manner, i.e., two materials are supplied separately, but may be made, for example, by supplying a uniform mixture of the magnetic particles and non-magnetic developer containing the sufficient amount of respective materials for the entire base layer 16 and developer layer 17, and then vibrating the container 13 to form the two layers, using the magnetic field of the magnet 14 and the difference in the specific gravity between the two materials.

After the magnetic and developer particles are supplied as described above, carrying member 12 is rotated. The magnetic particles are circulated by the magnetic field provided by the magnetic poles and the gravity, as shown in FIG. 1. More particularly, in the neighbourhood of the surface of the non-magnetic developer carrying member 12 near the bottom of the container 13, the magnetic particles move upwardly along the surface of the carrying member 12 by the cooperation of the magnetic field of the magnet 14 and the rotation of the carrying member 12. During this movement, the nonmagnetic developer particles contact the carrying member 12 surface so that the non-magnetic developer contained in the base layer 16 is coated on the carrying member 12 surface electrostatically.

In this embodiment of the present invention, the non-magnetic developer is triboelectrically charged by the contact with the magnetic particles and with the carrying member 12. Preferably, however, the triboelectric charge with the magnetic particles is reduced by treating the surface of the magnetic particles with an insulating material, such as oxide coating and a resin having the same electrostatic level as the non-magnetic developer, so that the necessary charging is effected by the contact with the carrying member 12 surface. Then, the deterioration of the magnetic particles is prevented, and simultaneously, the non-magnetic developer is stably coated on the carrying member 12.

The magnetic particles are moved upwardly too by the rotation of the carrying member 12, but prevented from passing through the clearance between the tip of the magnetic particle confining member 15 and the carrying member 12 by the magnetic field formed between the confining member 15 and magnetic pole N1. The magnetic particles behind the confining member 15 within the container 13 are urged by the magnetic particles fed continuously from the bottom of the container 13, and turn, as shown in FIG. 1, whereafter they slowly move down under gravity. During this downward movement, the magnetic particles take the non-magnetic developer particles among themselves from the lower part of the developer layer 17. Then, the magnetic particles return to the bottom part of the container 13, and those actions are repeated.

On the other hand, the triboelectrically charged non-magnetic developer particles, which are non-magnetic, are not limited by the magnetic field existing in the clearance between the tip of the confining member 15 and the surface of the carrying member 12, so that they are allowed to pass there, and they are coated as a thin layer of uniform thickness on the carrying member 12 by the magnetic brush formed at the confining member 15 and by the image force. The thin layer of the non-magnetic developer is thus conveyed out of the container 13, and moved to the developing station, where the thin layer is opposed to the photosensitive member 11 to develop a latent image thereon.

Figure 2:
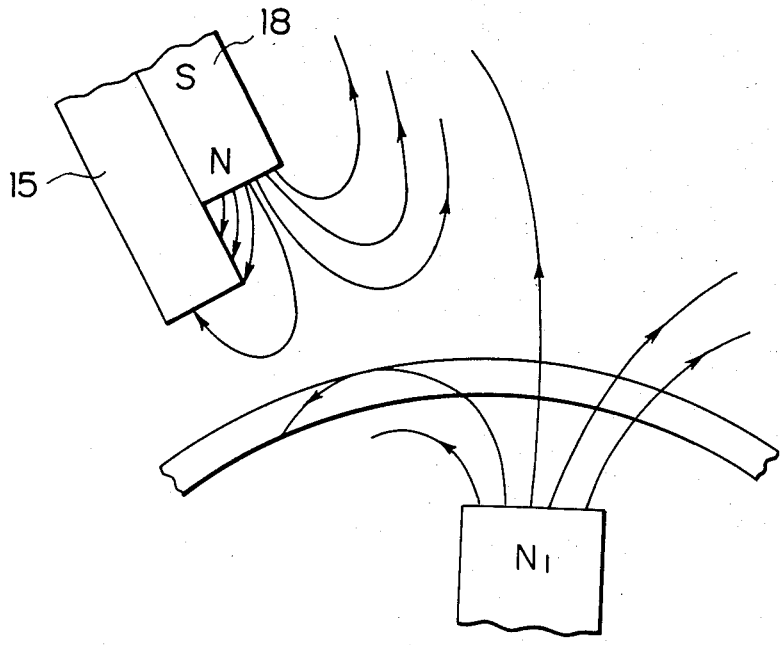
FIG. 2 illustrates the lines of magnetic force around the magnetic particle confining member in the apparatus of FIG. 2.

Next, a magnet 18, that is, an internal magnet 18 will be explained, which is one of the important features of the present invention. The internal magnet 18 is mounted upstream of the magnetic blade 15 with respect to the movement of the developer carrying member 12, that is, mounted on the inside of the developer container 13. Preferably, the internal magnet 18 is fixedly mounted on the magnetic blade 15, as shown in FIG. 1. This internal magnet 18 is effective to limit the distribution of the magnetic flux within the developer container 13, as shown in FIG. 2, thus preventing the existence of the magnetic force outside of the developer container 13. This is preferable because the magnetic particles right below the magnetic blade 15 are prevented from passing through the clearance between the magnetic blade 15 and the developer carrying member 12 surface and then reaching the developing station. If the magnetic particles are contained in the non-magnetic developer particles to be carried to the developing station on the developer carrying member, the leaked magnetic particles, at the developing station, partly transfer to the surface of the photosensitive member 11 and partly remain on the carrying member 12. The former particles partly do not transfer onto a transfer material at a subsequent image transfer station and then reach a cleaning station for cleaning the photosensitive member 11, where the magnetic particle will damage the delicate surface of the photosensitive member 11. The latter particles do not damage the photosensitive member 11, but they can release, by the resultant force of the gravity and the centrifugal force by the rotation of the carrying member 12, from the surface of the carrying member 12 to fall and scatter, thus staining the copying apparatus.

In this embodiment, the polarity of the internal magnet 18 which is opposed to the carrying member 12 is the same (N) as the magnetic pole N1 of the magnet inside the developer carrying member 12, but it may be the opposite (S). When it is of the same polarity, a repelling force is created between the magnetic pole N1 within the developer carrying member 12 and the internal magnet 18, whereby the magnetic particles are prevented from being clogged in the clearance between the internal magnet 18 and the surface of the developer carrying member 12. When the polarities are opposite, there is a tendency that the magnetic particles are attracted into the clearance. To avoid this, the surface magnetic flux density of the magnetic pole should be not more than 300 gauss. If it is over 300 gauss, the magnetic pole constrains the magnetic particles too strongly to allow the magnetic particles to damage the surface of the developer carrying member 12. It is preferable that the magnetic flux density is not more than 200 gauss, further preferably, not more than 100 gauss. Referring back to the same polarity arrangement (N polarity in this embodiment), the magnetic flux density is preferably not more than 300 gauss, more preferably not more than 150 gauss.

In the embodiment shown in FIG. 2, the N pole and S pole of the internal magnet 18 are aligned on a substantially vertical line, but they may be disposed along a substantially horizontal line with its N pole closer to the N1 pole of the fixed magnetic field generating means 14.

Figure 3:
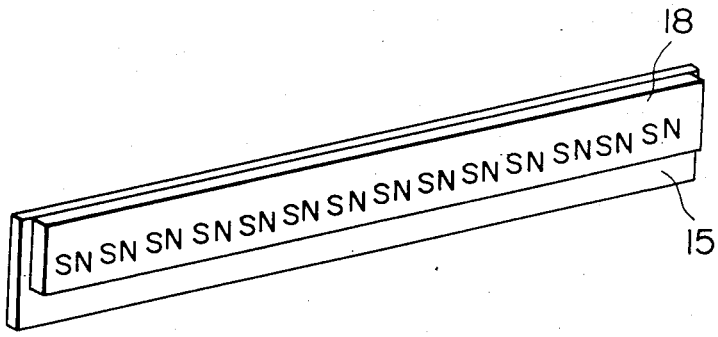
FIG. 3 is a perspective view of a magnet which is usable with an apparatus according to another embodiment of the present invention.

As shown in FIG. 3, the magnetic poles of the internal magnet 18 may be arranged to alternate along the longitudinal direction of the developer carrying member 12. It is preferable that the distance between the adjacent alternating poles is not more than 10 mm and that the strength of each of the poles is not more than 200 gauss. With this arrangement, the lines of magnetic force directed outside of the container 13 are oriented to the adjacent poles through the magnetic blade 15 so that the leakage of the lines of magnetic force to the outside of the container 13 can be further prevented, thus further ensuring against the leakage of the magnetic particles.

The developing system to be used here is preferably the non-contact type development disclosed in U.S. Pat. No. 4,395,476, although conventional contact type development is usable. Between the photosensitive member 11 and the carrying member 12, a voltage is applied by a bias voltage source 19 which is of AC, DC or preferably an AC superposed with a DC. The use of the developing bias is possible in all of the embodiments which will be described hereinafter.

The developer to be consumed for the development is supplied from the base layer 16, and the consumption of the developer in the base layer 16 is compensated from the developer layer 17 during the above-described circulation. Since the base layer 16 is formed around the carrying member 12 from the beginning, and since the developer layer 17 does not contain the magnetic particles, or if any, it contains only a small amount to compensate the unavoidably lost magnetic particles, the state of the magnetic brush formed in the base layer 16 is maintained constant over a long run of the device. In this sense, the magnetic particles within the base layer 16 is a part of the developing or thin layer forming apparatus, rather than a developer or a part of a developer.

A detailed example of the above embodiment of the present invention will be described.

The carrying member 12 of an aluminum cylinder having the outer diameter 20 mm was used. The surface of the cylinder was treated by irregular sand-blasting of ALUNDUM abrasive particles No. 600 to provide the surface roughness, in the circumferential direction, of 0.8 micron (RZ=0.8). Within the carrying member 12, a magnet 14 of ferrite sintering type was fixed in such a position that the magnetic particle confining pole N1 was 30 degrees away from the line connecting the center of the carrying member 12 and the tip of the confining member 15. The magnetic flux density of the pole N1 was 700 gauss (550 gauss at the surface of the developer carrying member 12), and the half-peak width thereof was 12.0 mm on the surface of the developer carrying member. The surface magnetic flux density of each of the poles S1 and N2 at the surface of the developer carrying member 12 was 450 gauss, and the half-peak width thereof was 6.0 mm. The magnetic pole S2 is provided because of the convenience of manufacturing the magnet to keep the surface magnetic flux density of the pole N1 larger.

The confining member, that is, the magnetic blade 15 was made of a steel and plated with nickel for rust prevention. The tip thereof was spaced apart by 100 microns from the surface of the carrying member 12.

The internal magnet 18 having the thickness of 4.0 mm was disposed to the developer carrying member 12 surface with a gap of 2.0 mm to provide 100 gauss of surface magnetic flux density.

As for the magnetic particle, 60 g of spherical ferrite was used, and for the non-magnetic developer, 20 g of positively chargeable developer of 12 microns average particle size was used. These are mixed and stirred, and then supplied into the developer container 13. When the developer carrying member 12 was rotated, the magnetic particles were completely constrained within the developer container. And, on the surface of the developer carrying memer 12 outside the container 13, a coating only of the nonmagnetic developer was formed.

Then, 200 g of non-magnetic developer only was supplied from the upper side of the container 13 to provide the two layer structure, and the developer carrying member 12 was rotated. A good and uniform coating of the non-magnetic developer was formed on the surface of the developer carrying member 12.

The thin coating of the non-magnetic developer obtained by the above structure was opposed to a photosensitive member bearing an electrostatic latent image of −750 V at the dark area and −250 V at the light area with the clearance of 300 microns to the surface of the photosensitive member 11. The bias voltage of 1.6 KHz and peak-to-peak voltage of 1.3 KV with the central value of −350 V was applied by the source 19. A PC-20 copying machine manufactured and sold by Canon Kabushiki Kaisha, Japan was used with the above conditions, and good resultant images without ghost or fog were obtained. Further, until 2000 copies were taken, that is, until most of the non-magnetic developer was consumed, non-magnetic particles were consumed for development.

As described above, according to this embodiment of the present invention, an internal magnet 18 is provided upstream of the magnetic particle confining member, that is, the magnetic blade 15, so as to form a thin layer of developer in the stabilized state. Further, the magnetic particles are prevented from leaking out and adversely affect the develped image or the latent image bearing member. Simultaneously, it is possible to provide a wider latitude for the usable non-magnetic developer and magnetic particles.

Figure 4:
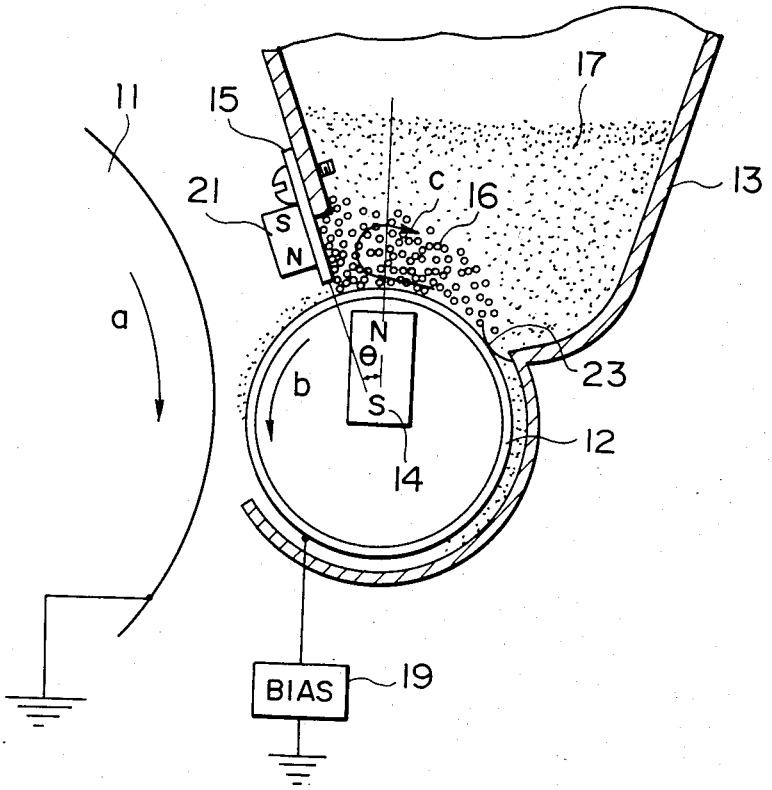
FIG. 4 is a cross-sectional view of an apparatus according to another embodiment of the present invention.

FIG. 4 shows another emboidment of the present invention. Since this embodiment is similar to the embodiment described with FIG. 1, except for the portions which will be described, the detailed description of the similar portions is omitted for the sake of simplicity by assigning the same reference numerals to the elements having the corresponding functions.

As shown in FIG. 4, a sealing member 23 is provided to ensure the prevention of the leakage of the developer. Within the developer carrying member 12, fixed magnetic field generating means, that is, a magnet 14 for producing a fixed magnet is fixedly secured. The magnet 14 has an N pole and an S pole. The N pole is effective to confine the magnetic particles within the container 13.

An external magnet 21 is provided outside the carrying member 12 and downstream of the magnetic blade 15 and upstream of the developing station with respect to the movement of the developer carrying member 12. The external magnet 21 has a magnetic pole N, the same polarity as of the magnetic pole of the magnet 14 which is opposed to the magnetic blade 15.

Figure 5:
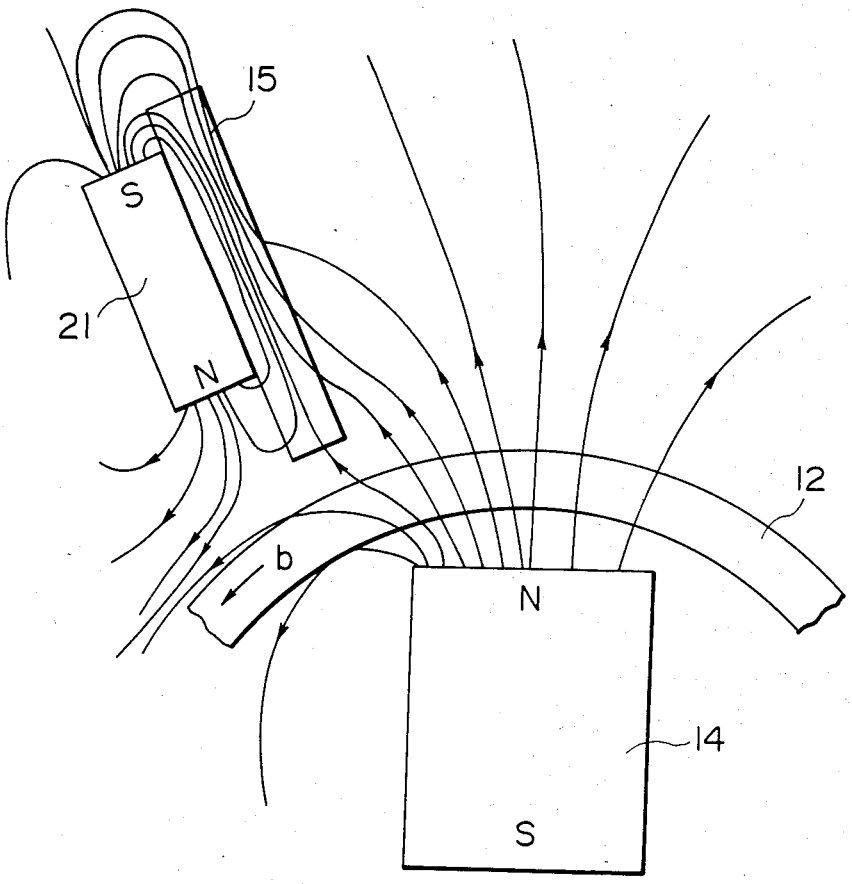
FIG. 5 is an enlarged view showing the distribution of the magnetic force lines around the magnetic blade in the apparatus of FIG. 4.

FIG. 5 shows the lines of magnetic force around the magnetic blade 15. As shown, the magnetic field around the magnetic blade 15 is such that the magnetic flux density provided by the magnet 14 is steeply decreased immediately downstream of the magnetic blade 15 with respect to the direction of the developer carrying member 12 movement. The steep decrease is created by the magnetic field formed by the magnet 21.

Figure 6:
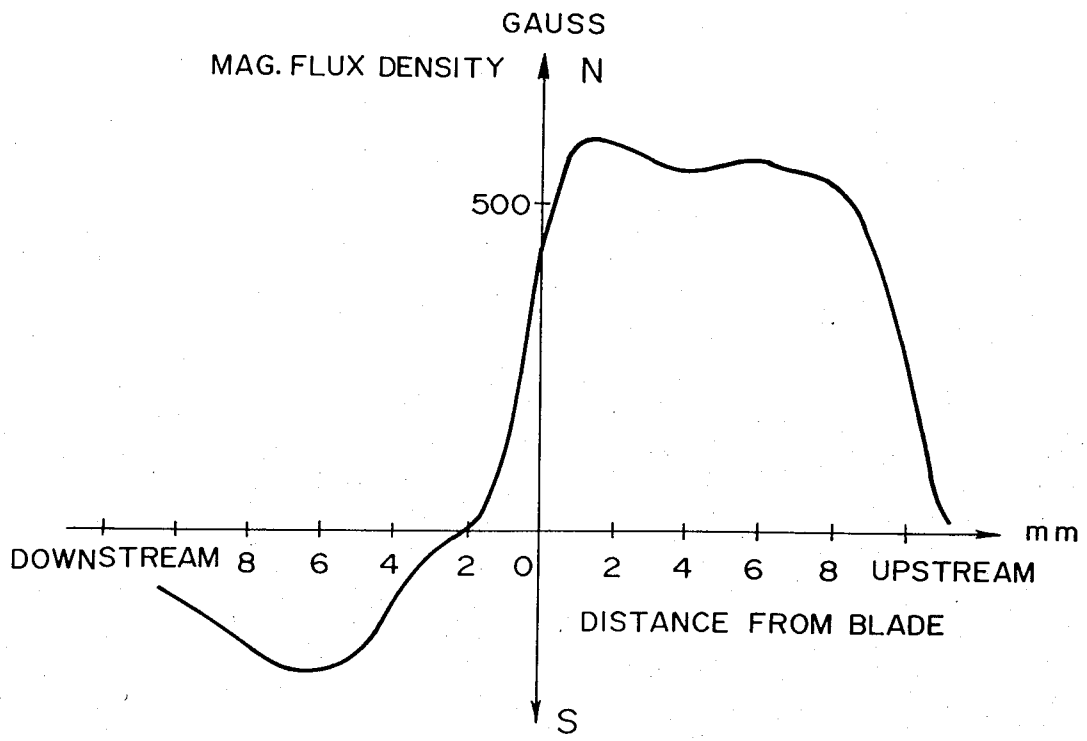
FIG. 6 shows the magnetic flux density on the surface of the developer carrying member around the magnetic blade in the apparatus of FIG. 4.

FIG. 6 shows this decrease. The magnetic field extending from the center of the developer carrying member 12 is represented in the positive direction. The sudden or steep decrease of the magnetic flux density adjacent to the magnetic blade 15 is effective to attract the magnetic particles toward the upstream with respect to the movement of the developer carrying member, so as to confine the magnetic particles in the upstream side of the magnetic blade, that is, to ensure the leakage prevention of the magnetic particles.

Figure 7:
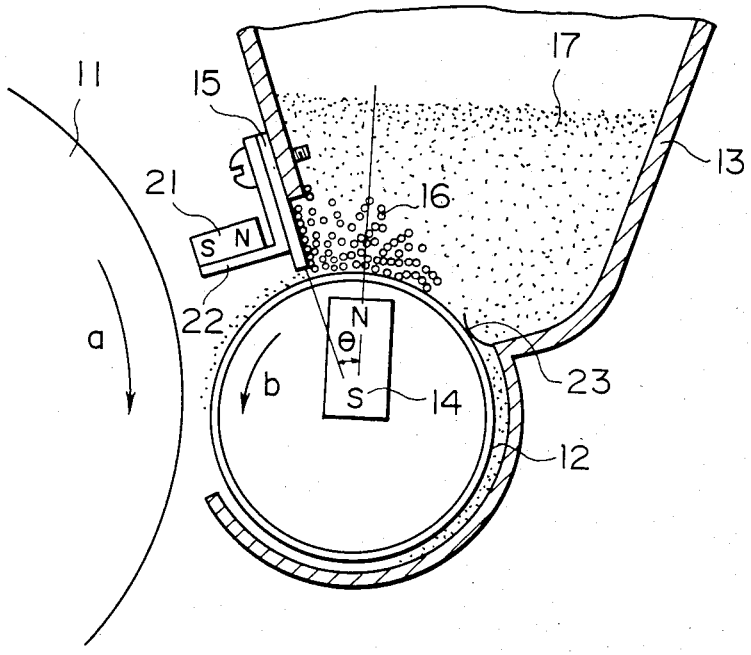
FIG. 7 is a cross-sectional view of an apparatus according to a further embodiment of the present invention.
Figure 8:
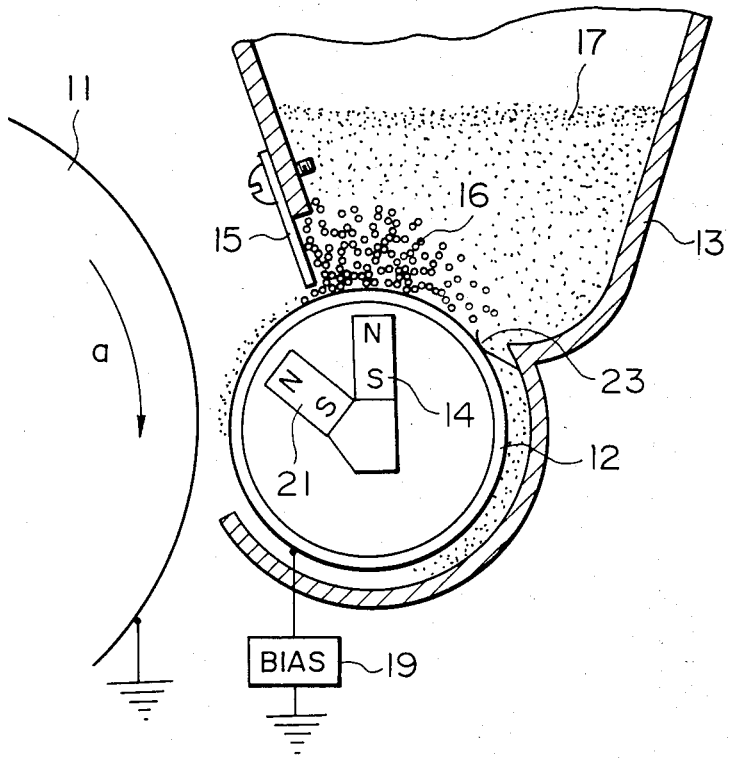
FIG. 8 is a cross-sectional view of an apparatus according to a further embodiment of the present invention.

In FIGS. 4 and 5, the external magnet 21 is shown as being fixedly secured on the magnetic blade 15, but this is not inevitable. As shown in FIG. 7, the magnet 21 may be mounted on a non-magnetic supporting member 22 in the manner that the magnetic field by the magnet 14 is prevented from existing downstream of the magnetic blade 15 with respect to the movement of the developer carrying member 12. As a further alternative, a magnetic pole may be formed at a proper position in the magnetic blade 15 itself. In this case, an N pole may be formed at the tip of the magnetic blade 15, or an N pole and an S pole are formed at the tip of the magnetic blade 15 with the N pole at the upstream side and the S pole at the downstream side with respect to the direction of the developer carrying member 12 movement. Further, as shown in FIG. 8, the magnet 21 may be disposed within the carrying member 12. As shown, the magnet 21 is disposed downstream of the blade 15 and upstream of the position where the developer carrying member 12 is faced to the photosensitive member 11.

As shown in FIGS. 4, 7 and 8, the magnetic pole having the same polarity as that of the magnet 14 effective to confine the magnetic particles is disposed downstream of the magnetic pole of the magnetic 14, so that the magnetic field by the magnet 14 is prevented from existing downstream of the magnetic blade 15 and that the similar functions of the magnetic particle confinement in any of the above embodiments are performed. In the embodiments, the magnetic pole opposed to the magnetic blade is shown as being N polarity, but of course, it may be S polarity. In this case, the polarity of the magnet 21 is the opposite, that is S polarity.

An example was constructed according to this embodiment, wherein the surface of the developer carrying member 12 was treated by irregular sand-blasting with an ALUNDUM abrasive. The diameter of the carrying member was 20 mm.

Within the carrying member 12, a magnet 14 magnetized with 6 poles was fixed in such a position that the magnetic particle confining pole (N) of approx. 600 gauss was 20–30 degrees away from the line connecting the center of the carrying member 12 and the tip of the confining member 15. As for the magnetic particles, spherical ferrite of particle size 20–80 microns (particle size distribution), average 50 microns, was used. For the non-magnetic developer a negative developer powder provided by 100 parts of polyester resin incorporated by 3 parts of copper phthalocyanine pigment and 5 parts of negative charge controlling agent (alkylsalicylic acid metal complex) and added by silica 0.5%, was used. The average particle size thereof was 12 microns. With these conditions, the above embodiments of the present invention was operated. Without the magnet 21, after a long time operation, that is, rotation of the carrying member 12, a slight amount of the magnetic particles was leaked out through the clearance between the magnetic blade 15 and the developer carrying member 12. However, with the magnet 21, leakage was prevented. As for the magnet 21, the plastic magnet was used to provide the surface magnetic flux density of approx. 800 gauss.

As described above, by the provision of the magnet 21 downstream of the confining member 15, stabilized thin layer formation is assured, and the leakage of the magnetic particles is avoided which leads to adversely affecting the developed image and the photosensitive member, and in addition, the usable range of the property of the magnetic particle and non-magnetic developer particle are made broader.

In the embodiments described above, the confining member 15 has been explained as of a magnetic material, such as steel. However, a non-magnetic confining member 15 may be made of a non-magnetic material such as aluminum, copper and resin. Also, the wall of the containing 13, if it is made of a non-magnetic material, may be used as the confining member 15. In this case, the clearance between the tip of the confining member 15 and the surface of the carrying member 12 is needed to be smaller than the clearance when the magnetic confining member 15 is used. The magnetic confining member 15 is preferable in that a stabilized magnetic brush is formed at the developer outlet by the magnetic field between the confining member 15 and the magnetic pole.

While the invention has been described with reference to the structures disclosed herein, it is not confined to the details set forth and this application is intended to cover such modification or changes as may come within the purposes of the improvements or the scope of the following claims.

What is claimed is:

1. A developable apparatus, comprising:

a developer supply container, having an opening, for containing a non-magnetic developer and magnetic particles;

an endlessly movable developer carrying member of a non-magnetic material for carrying a developer, which is movable between an inside of said developer supply container and an outside of said developer supply container through the opening;

a magnetic particle confining member, spaced from an outer surface of said developer carrying member with a gap;

means for generating a fixed magnetic field, having magnetic pole means disposed inside of said carrying member and upstream of said confining member with respect to the movement direction of said developer carrying member; and a magnet, disposed outside of said carrying member in proximity with said confining member at an upstream side thereof with respect to the movement direction of said developer carrying member.

2. An apparatus according to claim 1, wherein said magnet has a magnetic pole, opposed to said developer carrying member, of a polarity, the same as the polarity of the magnetic pole means of said fixed magnetic field generating means.

3. An apparatus according to claim 1, wherein said magnet has a magnetic pole, opposed to said developer carrying means, of a polaritiy, opposite to the polarity of the magnetic pole means of said fixed magnetic field generating means.

4. An apparatus according to claim 1 or 3, wherein said magnet provides a surface magnetic flux density of not more than 300 gauss.

5. An apparatus according to claim 1, wherein said magnet has magnetic poles disposed in a direction perpendicular to the movement direction of said developer carrying member and which poles are opposed to said carrying member, wherein adjacent ones of said magnetic poles are opposite in their magnetic polarities.

6. An apparatus according to claim 1, 2, 3 or 5, wherein said magnetic particle confining member includes a magnetic blade of a magnetic material.

7. An apparatus according to claim 6, wherein said magnet is fixedly secured to the magnetic blade.

8. A developing apparatus, comprising:

a developer supply container, having an opening, for containing a non-magnetic developer and magnetic particles;

an endlessly movable developer carrying member of a non-magnetic material for carrying a developer which is movable between an inside of said developer supply container and an outside of said developer supply container through the opening;

a magnetic particle confining member, spaced from an outer surface of said developer carrying member with a gap;

means for generating a fixed magnetic field, having magnetic pole means disposed inside of said carrying member and upstream of said confining member with respect to the movement direction of said developer carrying member; and a magnetic pole of the same polarity as that of the magnetic pole means of said fixed magnetic field generating means and disposed in close proximity with, downstream of said magnetic particle confining member with respect to the movement direction of said developer carrying member to steeply decrease, downstream thereof, a magnetic flux density, on a surface of the carrying member, of the magnetic field formed by the magnetic pole means of said fixed magnetic field generating means.

9. An apparatus according to claim 8, wherein the magnetic pole of the same polarity as that of the magnetic pole means is disposed outside of said carrying member.

10. An apparatus according to claim 9, wherein said confining member includes a magnetic blade of a magnetic material.

11. An apparatus according to claim 10, wherein said magnetic pole of the same polarity as that of the magnetic pole means is a magnetic pole of a magnet fixedly mounted on said magnetic blade.

12. An apparatus according to claim 10, wherein said magnetic pole of the same polarity as that of said magnetic means is formed in said magnetic blade.

13. An apparatus according to claim 8, wherein said magnetic pole of the same polarity as that of the magnetic pole means is provided inside of said carrying member.

14. An apparatus according to claim 1, wherein a surface magnetic flux density of a pole of said magnet is smaller than a surface magnetic flux density of said magnetic pole means of said magnetic field generating means which is closest to said confining member.

15. An apparatus according to claim 2, wherein said magnetic pole provides a surface magnetic flux density of not more than 150 gauss.

16. An apparatus according to claim 3, wherein said magnetic pole provides a surface magnetic flux density of not more than 200 gauss.

17. An apparatus according to claim 1, wherein said confining member is provided with a magnetic property cooperative with said magnetic pole means to form magnetic lines of force for confining the magnetic particles, and said magnet is fixed on a surface of said confining member.

18. An apparatus according to claim 1, wherein said developer carrying member is opposed to an image bearing member bearing an electrostatic latent image thereon to establish a developing portion, where the developer in the form of a thin layer on the developer carrying member is applied to the electrostatic latent image.

19. An apparatus according to claim 8, wherein said developer carrying member is opposed to an image bearing member bearing an electrostatic latent image thereon to establish a developing portion, where the developer in the form of a thin layer on the developer carrying member is applied to the electrostatic latent image.

20. An apparatus according to claim 8, wherein a surface magnetic flux denxity of said magnetic pole is larger than a surface magnetic flux density of said magnetic pole means of said magnetic field generating means which is closest to said confining member.

21. An apparatus according to claim 8, wherein said confining member is provided with a magnetic property cooperative with said magnetic pole means to form magnetic lines of force for confining the magnetic particles, and said magnetic pole is fixed on a surface of said confining member.

22. An apparatus according to claim 11, wherein said magnet is fixed on said confining member by way of a non-magnetic member joined to said confining member.

23. An apparatus for forming a thin developer layer, comprising:

a developer container, having an opening, for containing a non-magnetic developer and magnetic particles;

an endlessly movable developer carrying member of a non-magnetic material for carrying a developer, which is movable between an inside of said developer container and an outside of said developer container through the opening;

a magnetic regulating member spaced from said developer carrying member at a position where the developer is discharged out of said developer container;

means for generating a fixed magnetic field, having a magnetic pole disposed inside said carrying member and upstream of said regulating member with respect to the movement direction of said developer carrying member; and a magnet disposed outside said carrying member and adjacent to said regulating member and having a magnetic pole, the polarity of which is the same as that of said magnetic pole of said fixed magnetic field generating means;

wherein by a magnetic field formed between said fixed magnetic field generating means and said magnetic regulating member and by a repelling magnetic field formed between said magnet and said magnetic pole of said fixed magnetic field generating means, the magnetic particles are confined in said developer container, and a thin layer of only the non-magnetic developer is formed on the developer carrying member.

24. An apparatus according to claim 23, wherein said developer carrying member is opposed to an image bearing member bearing an electrostatic latent image thereon to establish a developing portion where the thin layer of developer on the developer carrying member is applied to the electrostatic latent image.

25. A developing apparatus comprising a container for containing a developer including magnetic particles and electrically chargeable non-magnetic particles, said container defining an opening;

a rotatable developer carrying member disposed in the opening of said developer container, said member being a non-magnetic cylinder;

stationary magnetic field generating means, disposed in said developer carrying member, for generating a stationary magnetic field;

a non-magnetic blade disposed adjacent a position where said rotatable developer carrying member carries the developer out of said developer container, said non-magnetic blade being spaced from said developer carrying member with a first clearance; and a magnetic member disposed on an upstream side of said non-magnetic blade with respect to the rotation direction of said developer carrying member, said magnetic member being spaced from said developer carrying member with a second clearance larger than the first clearance;

wherein said stationary magnetic field generating means has a magnetic pole at a position upstream of said non-magnetic blade and said magnetic member with respect to the rotation direction of said developer carrying member.

26. An apparatus according to claim 25, wherein an angle formed between said non-magnetic blade and said magnetic pole with respect to a center of said cylindrical developer carrying member is not less than 5 degrees and not more than 50 degrees.

27. An apparatus according to claim 25, wherein said magnetic member provides a surface magnetic flux density not more than 300 Gauss.

28. An apparatus according to claim 27, wherein said magnetic member provides a surface magnetic flux density not more than 200 Gauss.

29. An apparatus according to claim 28, wherein said magnetic member provides a surface magnetic flux density not more than 100 Gauss.

* * * * *

UNITED STATES PATENT AND TRADEMARK OFFICE

CERTIFICATE OF CORRECTION

PATENT NO. : 4,637,706

DATED : January 20, 1987

INVENTOR(S) : ATSUSHI HOSOI, ET AL.

It is certified that error appears in the above-identified patent and that said Letters Patent is hereby corrected as shown below:

COLUMN 1

Line 17, "necessiated" should read --necessitated--.
Line 37, "a formation of" should read --form a--.

COLUMN 2

Line 4, "another" should read --another object--.
Line 4, "a" should read --an--.
Line 33, "reduce" should read --reduces--.
Line 34, "is" should read --are--.
Line 40, "magetic" should read --magnetic--.

COLUMN 4

Line 8, "and" should read --but--.
Line 17, "above-descrived" should read --above-described--.

COLUMN 7

Line 50, "memer" should read --member--.

COLUMN 8

Line 11, "affect the developed" should read --affecting the developed--.
Line 15, "emboidment" should read --embodiment--.
Line 26, "magnet" should read --magnetic field--.

COLUMN 9

Line 10, "magnetic 14" should read --magnet 14--.
Line 61, "taining 13," should read --tainer 13,--.

UNITED STATES PATENT AND TRADEMARK OFFICE

CERTIFICATE OF CORRECTION

PATENT NO. : 4,637,706

DATED : January 20, 1987

INVENTOR(S) : ATSUSHI HOSOI, ET AL.

It is certified that error appears in the above-identified patent and that said Letters Patent is hereby corrected as shown below:

COLUMN 10

Line 10, "developable" should read --developing--.

COLUMN 11

Line 6, "means and" should read --means,--.
Line 7, "with," should read --with and--.

COLUMN 12

Line 49, "comprising" should read --comprising:--.

Signed and Sealed this

Twenty-ninth Day of September, 1987

*Attest:*

DONALD J. QUIGG

*Attesting Officer* *Commissioner of Patents and Trademarks*